US006347673B1

(12) United States Patent
Dailey

(10) Patent No.: US 6,347,673 B1
(45) Date of Patent: Feb. 19, 2002

(54) PERFORATING GUNS HAVING MULTIPLE CONFIGURATIONS

(75) Inventor: Terrell E. Dailey, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/483,064

(22) Filed: Jan. 14, 2000

Related U.S. Application Data

(60) Provisional application No. 60/116,191, filed on Jan. 15, 1999.

(51) Int. Cl.[7] ..... E21B 43/117

(52) U.S. Cl. ..... 175/4.6; 166/297; 102/310

(58) Field of Search ..... 166/297, 55, 55.1, 166/55.2; 175/4.51–4.55, 4.6; 102/310, 320

(56) References Cited

U.S. PATENT DOCUMENTS

| | | | | |
|---|---|---|---|---|
| 2,799,224 | A | | 7/1957 | Long |
| 2,927,534 | A | | 3/1960 | Le Bus |
| 3,094,930 | A | | 6/1963 | Blair |
| 3,100,443 | A | | 8/1963 | Pohoriles |
| 4,326,462 | A | | 4/1982 | Garcia et al. |
| 4,393,946 | A | | 7/1983 | Pottier et al. |
| 4,583,602 | A | * | 4/1986 | Ayers |
| 4,598,775 | A | | 7/1986 | Vann et al. |
| 4,658,900 | A | | 4/1987 | Stout |
| 4,681,037 | A | | 7/1987 | Regalbuto |
| 4,694,754 | A | | 9/1987 | Dines et al. |
| 4,726,431 | A | * | 2/1988 | Oestreich et al. |
| 4,773,299 | A | * | 9/1988 | Oestreich et al. |
| 4,829,901 | A | | 5/1989 | Yates, Jr. |
| 4,832,134 | A | | 5/1989 | Gill |
| 4,881,445 | A | | 11/1989 | Hayes |
| 4,951,744 | A | | 8/1990 | Rytlewski |
| 4,960,171 | A | * | 10/1990 | Parrott et al. |
| 5,054,564 | A | * | 10/1991 | Oestreich et al. |
| 5,095,999 | A | | 3/1992 | Markel |
| 5,107,929 | A | | 4/1992 | Lopez de Cardenas |
| 5,421,418 | A | | 6/1995 | Nelson et al. |
| 5,542,480 | A | | 8/1996 | Owen et al. |
| 5,590,723 | A | | 1/1997 | Walker et al. |
| 5,701,964 | A | | 12/1997 | Walker et al. |
| 5,816,343 | A | | 10/1998 | Markel et al. |

* cited by examiner

*Primary Examiner*—Roger Schoeppel
(74) *Attorney, Agent, or Firm*—Trop, Pruner & Hu P.C.

(57) ABSTRACT

A perforating gun system includes shaped charges and a carrier housing containing the shaped charges and having a pattern of scallops (or other forms of perforating jet passageways). The shaped charges have one of a plurality of arrangements with respect to the scallops to provide one of a plurality of different phasing patterns and/or shot densities. The pattern of scallops includes a first set that provides a first phasing pattern and a second set that provides a second phasing pattern.

23 Claims, 4 Drawing Sheets

4.5 HSD 60°/120° AT 6 SPF

PERFORATING GUNS HAVING MULTIPLE CONFIGURATIONS

This application claims priority under 35 U.S.C. §119(e) to U.S. Provisional Application Ser. No. 60/116,191, entitled "PERFORATING GUNS HAVING MULTIPLE CONFIGURATIONS," filed Jan. 15, 1999.

BACKGROUND

The invention relates to perforating guns having selectable multiple configurations including phasing patterns and shot densities.

After a well has been drilled and casing has been cemented in the well, one or more sections of the casing may be perforated for either production or injection of fluids. Perforation operations are performed using perforating gun strings, which are lowered into the well to a desired depth and fired to create openings in the casing and to extend perforations into the surrounding formation.

Depending on the desired hole pattern to be created by a perforating gun, shaped charges may be arranged in a number of different phasing patterns. Possible phasing patterns include spiral patterns, such as 45°, 60°, or 90° spiral patterns; two-phase patterns (e.g., ±90°, ±45°, etc.); tri-phase patterns (e.g., +45°/0°/−45°, etc.), and other phasing patterns. In addition, the shot density of a perforating gun system may be varied by adjusting the number of shaped charges within any given distance. For example, typical shot densities may include 4 shots per foot (SPF), 5 SPF, 6 SPF, 10 SPF, 12 SPF, and so forth. Shots per foot refer to the number of shaped charges that can be mounted in a perforating gun in a given foot.

Various types of perforating guns exist. A first type is a strip gun that includes a strip carrier on which capsule shaped charges may be mounted. The capsule shaped charges are contained in sealed capsules to protect the shaped charges from the well environment. Another type of gun is a sealed hollow carrier gun, which includes a hollow carrier in which non-capsule shaped charges may be mounted. The shaped charges may be mounted on a loading tube or strip inside the hollow carrier.

Thinned areas (referred to as scallops) may be formed in the wall of the hollow carrier housing to allow easier penetration by perforating jets from fired shaped charges. Typically, a pattern of scallops is formed in the carrier housing according to a desired phasing pattern. If a loading tube is used, holes are also formed in the loading tube according to the phasing pattern to align shaped charges to the scallops in the carrier gun housing.

Conventionally, to provide multiple shot density and phasing configurations, several variations of each type of perforating gun are kept readily available. This creates the problem of ordering and storing a relatively large number of parts, since desired types and variations of guns in adequate quantities may need to be kept in anticipation of the needs of a well operator. If a particular type of gun is not available, then well operations may be delayed while waiting for the part. Also, the unavailability of a perforating gun having a desired perforating phasing pattern and/or shot density may prevent creation of optimum perforations in a formation. Thus, a need continues to exist for improved perforating gun systems.

SUMMARY

In general, according to one embodiment, a perforating gun system comprises shaped charges and a carrier housing in which the shaped charges are contained. The carrier housing has an outer surface defining an arrangement of scallops. A first set of the scallops provides a first phasing configuration and a second, distinct set of scallops provides a second phasing configuration.

Other features and embodiments will become apparent from the following description, the drawings, and the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
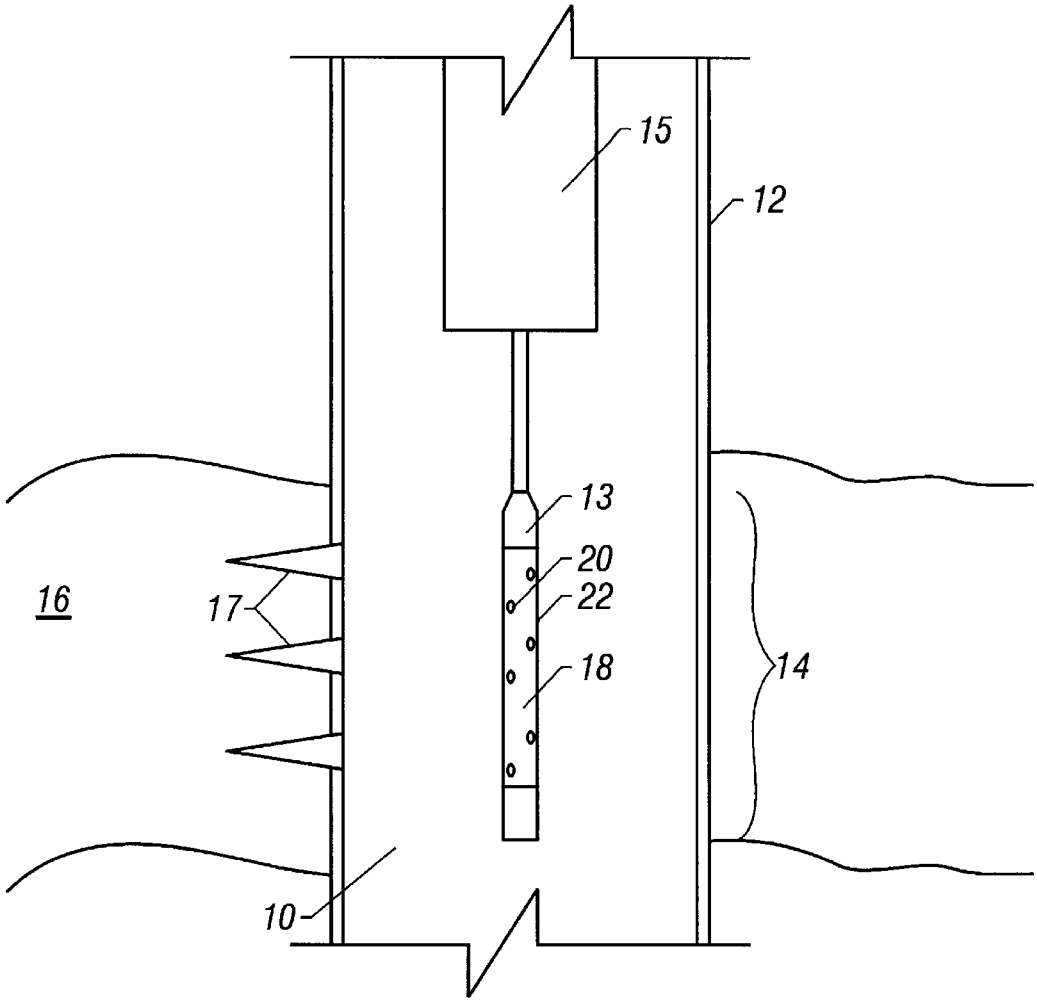
FIG. 1 illustrates an embodiment of a perforating gun string in a wellbore.
Figure 2:
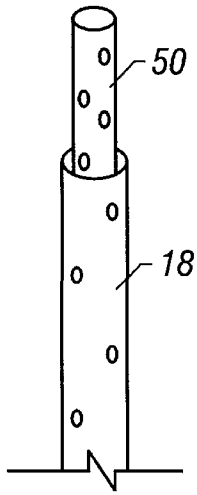
FIGS. 2 and 3 illustrate alternative embodiments of perforating guns useable in the gun string of FIG. 1.
Figure 3:
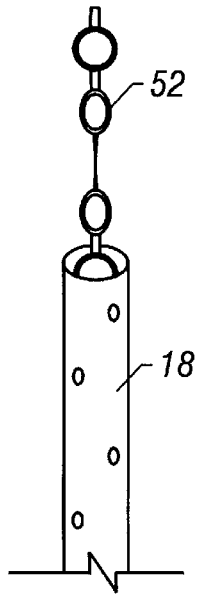

Referring to FIG. 1, a perforating gun string 14 according to one embodiment is positioned in a wellbore 10 that may be lined with casing 12. The gun string may be lowered through tubing 15 to a depth proximal a hydrocarbon bearing formation 16. Once lowered to the desired depth, the gun string 14 is fired to create openings in the casing 12 and to extend perforations 17 into the formation 16. The perforating gun string 14 may include one or more perforating guns 22 (one shown in FIG. 1). A firing head 13 in the perforating gun string 14 can be activated using any one of known mechanisms to fire the gun string 14. The perforating gun 22 includes a hollow carrier housing 18 having a pattern of scallops or recesses 20, which are thinned portions in the carrier housing 18 that allow penetration of perforating jets created by shaped charges. In one embodiment, as shown in FIG. 2, the gun string 14 includes a loading tube inside the carrier housing 18 having a corresponding pattern of holes (aligned with the scallops 20) in which shaped charges may be mounted. In another embodiment, as shown in FIG. 3, the shaped charges may be mounted on a strip 52 in the carrier housing 18. The shaped charges may be mounted on the strip 52 in a desired phasing arrangement relative to the scallops formed in the hollow carrier housing 18.

The described embodiment refers to scallops or recesses formed in the outer wall of the carrier housing 18. In further embodiments, holes or openings (instead of scallops) may be formed in the carrier housing 18 through which perforating jets of fired shaped charges may shoot through. Thus, generally, the carrier housing 18 may include a predetermined pattern of perforating jet passageways (in the form of scallops, holes, or otherwise) that allow for multiple shot configurations.

The scallop pattern on the carrier housing 18 provides several choices of shot densities and phasing patterns. As used here, shot density refers to the number of shaped charges that can be fired in a given length of gun. Phasing pattern refers to the angular relationship of a group of shaped charges in the gun. For example, in one embodiment, three configurations may be available: (1) 6 shots per foot (SPF), 120° left-hand spiral or helical phasing; (2) 6 SPF, 60° right-hand spiral or helical phasing; and (3) 12 SPF, 60° multi-spiral phasing (in which shaped charges are arranged in multiple spirals or helices). In further embodiments having other patterns of scallops 20, other shot densities and phasing patterns may also be available. Thus, a perforating gun in accordance with some embodiments provides for greater flexibility since one of several different shot densities and phasing patterns may be selected. Consequently, the number of parts that need to be stored may be reduced, thereby reducing storage space requirements as well as costs associated with well operation. Further, the likelihood of delay in well operation while waiting for a part to arrive is also reduced.

The flexibility in selecting shot densities and phasing patterns may be provided by arranging patterns of scallops (in the carrier housing) or patterns of holes (in the loading tube if used) in two or more spirals that start at different positions along the circumference of the carrier housing or loading tube. Shots may be spaced on one of the spirals at selected positions to adjust shot density. By mounting shaped charges in a loading tube or strip according to different patterns, different phasing patterns and shot densities may be achieved with the perforating gun system.

Figure 4:
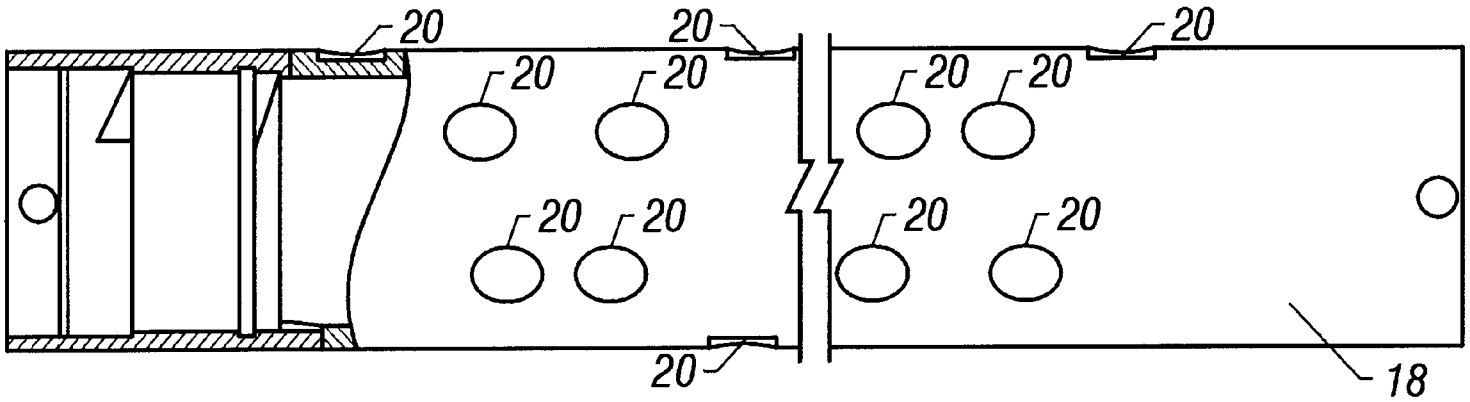
FIG. 4 illustrates a portion of a perforating gun carrier housing in accordance with an embodiment.

Referring to FIG. 4, the carrier housing 18 includes a plurality of recesses or scallops 20. In the illustrated embodiment, a first phasing pattern may include a 60° right-hand helical pattern that provides a shot density of 6 SPF. A second phasing pattern may include a 120° left-hand helical pattern that provides a shot density of 6 SPF. A third "fully loaded" pattern is a 60° double spiral phasing pattern that provides a shot density of 12 SPF.

Figure 5:
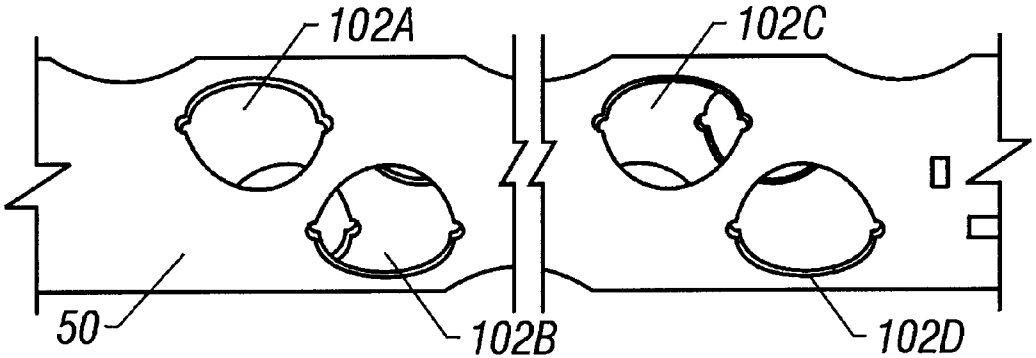
FIG. 5 illustrates a portion of a loading tube in accordance with an embodiment that is mountable in the carrier housing of FIG. 4.

Referring to FIG. 5, the loading tube 50 that may be mounted in the carrier 18 includes generally tubular housing having a corresponding pattern of holes 102 (102A–102D illustrated) in which shaped charges are mounted. The holes, arranged according to a phasing pattern corresponding to the phasing pattern of the scallops 20 in the carrier housing 18, align mounted shaped charges to corresponding scallops 20.

Figure 6:
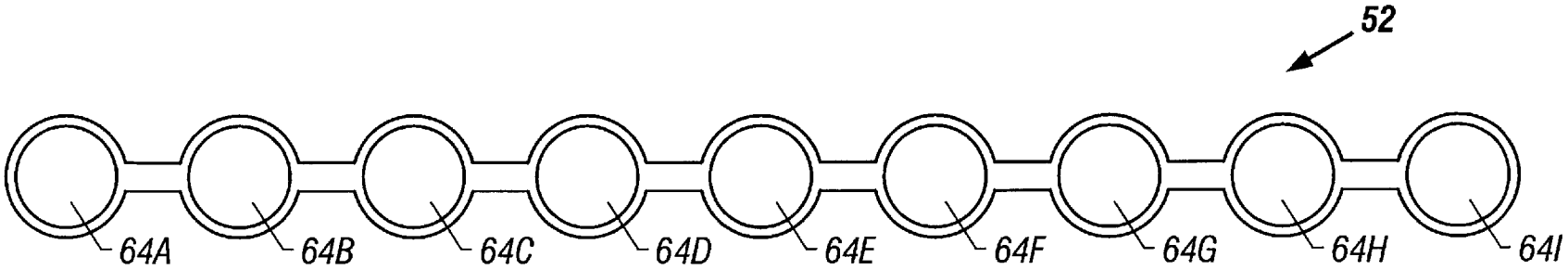
FIGS. 6 and 7 illustrate a strip mountable in a hollow carrier housing in accordance with another embodiment.
Figure 7:
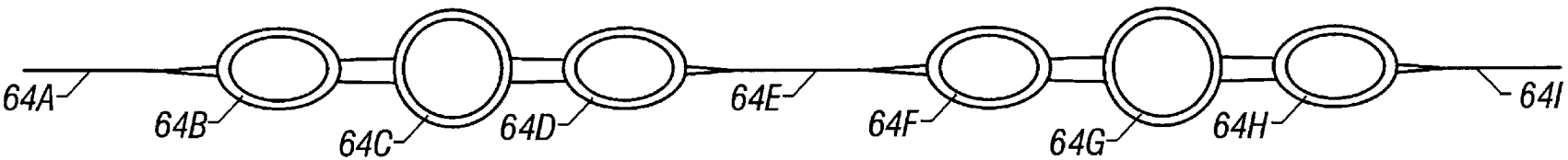

Referring to FIGS. 6 and 7, in an alternative embodiment, the strip 52 instead of a loading tube may be utilized. The strip 52 includes a plurality of support rings 64A–I. Shaped charges may be mounted in corresponding support rings 64. To provide a desired phasing pattern, the strip 52 may be twisted to the desired pattern, as shown in FIG. 7. Shaped charges mounted on the strip 52 are oriented to line up with corresponding scallops 20 on the carrier housing 18. In further embodiments, other types of strips with different mounting or fastening mechanisms may be used.

Figure 8:
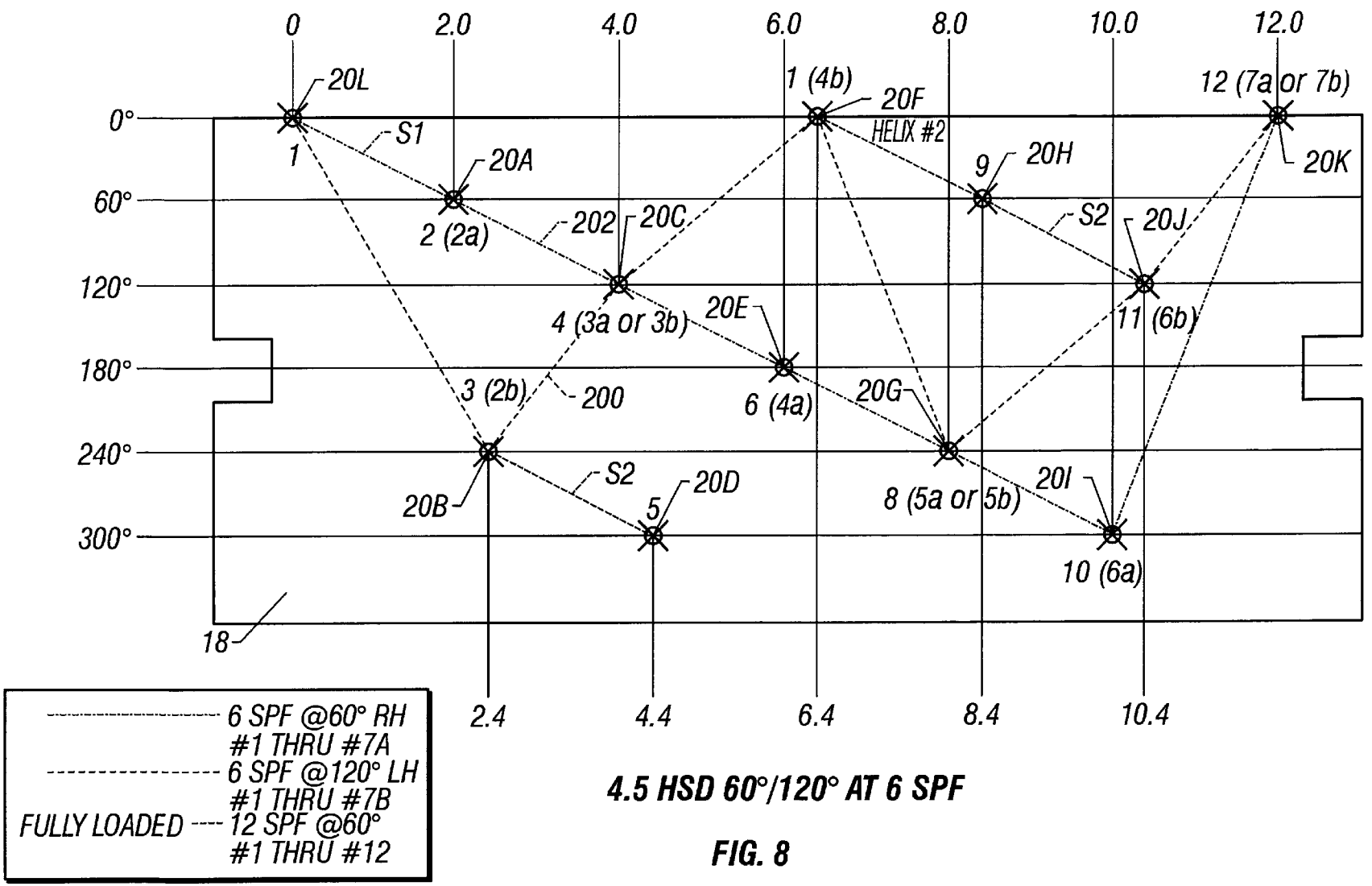
FIG. 8 illustrates several possible phasing patterns of scallops or recesses formed in the perforating gun carrier housing of FIG. 4.

Referring to FIG. 8, a diagram of the three possible configurations of scallops 20 on the carrier housing 18 according to one embodiment is illustrated. Holes 102 on the loading tube 50 may be similarly arranged. In the illustrated embodiment, the example pattern includes two right-hand spirals S1 and S2, about 180° apart, with holes at about two-inch intervals and 60° apart. The first spiral S1 includes scallops 20L, 20A, 20C, 20E, 20G, 20I, and 20K. The second spiral S2 includes scallops 20B, 20D, 20F, 20H, 20J, and 20K.

Thus, according to one general embodiment, the pattern of scallops includes a first spiral arrangement of scallops and a second spiral arrangement of scallops offset from the first spiral arrangement. In other embodiments, the pattern of scallops may be arranged differently so that different shot configurations (including phasing patterns and shot densities) may be achieved.

An imaginary dashed line 202 (corresponding to the spiral S1) connecting scallops 20L, 20A, 20C, 20E, 20G, 20I, and 20K represents a first phasing pattern, which is the 60° right-hand helical pattern providing a shot density of 6 SPF. In this pattern, every hole on the spiral Si is used. It is noted that the scallop 20K is the first scallop of the next foot of gun.

An imaginary dashed line 200 connecting scallops 20L, 20B, 20C, 20F, 20G, 20J, and 20K represents a 120° left-hand helical pattern that provides a shot density of 6 SPF. In this pattern, every other hole on each spiral S1 and S2 is used. Again, the scallop 20K represents the first scallop of the next foot of gun.

For a fully loaded configuration, all 12 scallops 20A–20L are used in a 60° phasing pattern to provide a shot density of 12 SPF. The sequence of scallops 20 in the fully loaded configuration may be as follows: 20L, 20A, 20B, 20C, 20D, 20E, 20F, 20G, 20H, 20I, 20J, and 20K. The fully loaded 60° phasing pattern includes two spirals.

Thus, according to embodiments of the invention, plural phasing patterns and shot densities can be provided in a perforating gun without having to change carrier housings or loading tubes. The shot density may be maintained the same while the phasing pattern is changed, or both shot density and phasing pattern may be changed.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A perforating gun system comprising:

shaped charges; and a carrier housing containing the shaped charges and having a predetermined pattern of scallops, wherein the shaped charges have a plurality of possible arrangements with respect to the predetermined pattern of scallops to provide one of a plurality of different phasing patterns, and wherein the different phasing patterns include different spiral phasing patterns, and each of the different spiral phasing patterns provides the same shot density.

2. The perforating gun system of claim 1, further comprising a loading tube having a pattern of holes in which the shaped charges may be mounted, the shaped charges mounted in different combinations of the holes to achieve different phasing patterns.

3. The perforating gun system of claim 2, wherein the pattern of holes in the loading tube are aligned to corresponding scallops in the carrier housing.

4. The perforating gun system of claims 1, further comprising a strip contained in the carrier housing, the shaped charges mounted on the strip.

5. The perforating gun system of claim 4, wherein the shaped charges are mounted on the strip in a desired phasing pattern.

6. The perforating gun system of claim 5, wherein the shaped charges are mounted in alignment with a desired subset of the scallops.

7. The perforating gun system of claim 1 wherein different spiral phasing patterns include at least one of a right-hand spiral pattern and a left-hand spiral pattern.

8. The perforating gun system of claim 7, wherein the right-hand spiral pattern includes a 60°-spiral pattern.

9. The perforating gun system of claim 8, wherein the left-hand spiral pattern includes a 120°-spiral pattern.

10. A perforating gun comprising:

shaped charges; and a carrier housing in which the shaped charges are contained, the carrier housing having an outer surface defining a pattern of perforating jet passageways, a first set of the perforating jet passageways providing a first spiral pattern, and a second set of the perforating jet passageways providing a second spiral pattern, and the first and second spiral patterns providing the same shot density.

11. The perforating gun of claim 10, wherein the perforating jet passageways include at least one of holes and scallops.

12. A perforating gun system comprising:

shaped charges; and a carrier housing containing the shaped charges and having a predetermined pattern of scallops, wherein the shaped sharges have a plurality of possible arrangements with respect to the predetermined pattern of scallops to provide one of a plurality of different phasing patterns, and wherein the pattern of scallops includes a first spiral arrangement, of scallops and a second spiral arrangement of scallops offset from the first spiral arrangement, the first and second spiral arrangements providing the same shot density.

13. The perforating gun system of claim 12, wherein the first and second arrangement of scallops are offset by about 180°.

14. The perforating gun system of claim 12, wherein at least one of the first and second spiral arrangements includes scallops that are spaced about 2 inches apart along an axial length of the carrier housing.

15. The perforating gun system of claim 12, wherein the first spiral arrangement of scallops provides a first spiral phasing pattern.

16. The perforating gun system of claim 15, wherein a combination of selected scallops in the first and second arrangements provides a second spiral phasing pattern.

17. The perforating gun system of claim 16, wherein all scallops in the first and second arrangements provide a multi-spiral phasing pattern.

18. A loading tube for mounting shaped charges in a hollow carrier of a perforating gun, comprising:

a tubular housing having a pattern of holes in which shaped charges are mountable, a first set of holes providing a first spiral pattern, and a second, distinct set of holes providing a second spiral pattern, and the first and second spiral patterns providing the same shot density.

19. A method of providing different shot configurations in a perforating gun, comprising:

arranging a predetermined pattern of recesses on a housing of the perforating gun; and mounting shaped charges in the perforating gun to align with one of plural combinations of the recesses to achieve one of plural shot configurations including phasing patterns, wherein arranging the predetermined pattern of recesses includes arranging at least two sets of recesses to provide at least two different spiral patterns, each providing the same shot density.

20. A perforating gun system,comprising:

shaped charges; and a carrier housing in which the shaped charges are contained, the carrier housing having an outer surface defining an arrangement of scallops, a first set of the scallops providing a first phasing configuration and a second set of scallops providing a second phasing configuration, wherein the first and second phasing configurations include different spiral patterns, the different spiral patterns providing the same shot density.

21. The perforating gun system of claim 20, wherein the different spiral patterns include a right-hand spiral pattern and a left-hand spiral pattern.

22. The perforating gun system of claim 20, wherein the different spiral patterns include at least a 60° right-hand spiral pattern and a 120° left-hand spiral pattern.

23. The perforating gun system of claim 21, wherein the different spiral patterns further include a multi-spiral phasing pattern.

* * * * *